US005479994A

United States Patent [19]

Soloviev et al.

[11] Patent Number: 5,479,994

[45] Date of Patent: Jan. 2, 1996

[54] METHOD OF ELECTROTHERMOMECHANICAL DRILLING AND DEVICE FOR ITS IMPLEMENTATION

[75] Inventors: Georgy N. Soloviev; Boris B. Kudryashov; Vladimir S. Litvinenko, all of St. Petersburg, Russian Federation

[73] Assignee: Sankt-Peter Burgsky Gorny Institut ImeniG.V./Plekhanova, St. Petersburg, Russian Federation

[21] Appl. No.: 185,910

[22] PCT Filed: Jun. 17, 1992

[86] PCT No.: PCT/RU92/00120

§ 371 Date: Feb. 1, 1994

§ 102(e) Date: Feb. 1, 1994

[87] PCT Pub. No.: WO93/20323

PCT Pub. Date: Oct. 14, 1993

[30] Foreign Application Priority Data

Apr. 3, 1992 [RU] Russian Federation ..... 5036112

[51] Int. Cl.[6] ..... E21B 7/14

[52] U.S. Cl. ..... 175/11; 175/16; 299/14

[58] Field of Search ..... 175/11, 12, 13, 175/14, 15, 16; 299/14

[56] References Cited

U.S. PATENT DOCUMENTS

| | | | |
|---|---|---|---|
| 3,693,731 | 9/1972 | Armstrong et al. | 175/16 X |
| 4,590,348 | 5/1986 | Lahti et al. | 299/14 X |

FOREIGN PATENT DOCUMENTS

| | | | |
|---|---|---|---|
| 2385882 | 10/1978 | France . | |
| 2388125 | 11/1978 | France . | |
| 47902 | 2/1979 | U.S.S.R. | 175/16 |
| 1078068 | 3/1984 | U.S.S.R. . | |
| 1087648 | 4/1984 | U.S.S.R. . | |
| 1620581 | 1/1991 | U.S.S.R. . | |
| 1627694 | 2/1991 | U.S.S.R. . | |

OTHER PUBLICATIONS

Maximov V. I. et al. "Novye sposoby bureniya skvazhin" seria: Tekhnika i tekhnologia geologorazvedochnykh rabot; organizatsia proizvodstva, 1971, VIEMS(Moscow) pp. 32–35.

Spravochnik po bureniyu i oborudovaniju skvazhin na vodu, pod redaktsiei Dubrovskogo V. V., 1972, Nedra (Moscow).

*Primary Examiner*—William P. Neuder

*Attorney, Agent, or Firm*—Lackenbach Siegel Marzullo Aronson & Greenspan

[57] ABSTRACT

The proposed invention relates to the mining industry and may be used for drilling wells in loose rock, in particular in quaternary deposits and in technogenic rocks with simultaneous durable and ecologically clean tubingless well cementing. The proposed method is based on loosening of the rock by its preliminary drying at the temperature of 400–450 K., its dehydration at the temperature of 700–750 K., burning out organic admixtures and its dissociation with separation of the gaseous phase at the temperature of 750–950 K. with subsequent compacting by means of the rock-crushing instrument mounted at the lower part of a thermomechanical penetrator, and on thermal transformation of the compacted rock (caking, roasting, fusion) by means of a cylindrical heater with the working temperature of 1800–2300 K. Also provided is a device for implementing the method of well drilling in which the lower working end face part of a thermomechanical penetrator consists of a rock-crushing cone (7) with a smooth external surface of a conical worm (23) or a peak-drill (24) which are reinforced by a hard alloy.

4 Claims, 3 Drawing Sheets

METHOD OF ELECTROTHERMOMECHANICAL DRILLING AND DEVICE FOR ITS IMPLEMENTATION

FIELD OF THE INVENTION

This invention relates to the mining industry and more particularly to drilling holes in loose rocks, specifically in quaternary deposits and technogenic soils with simultaneous durable and ecologically clean tubeless linings for different types of hydrogeological and engineering wells (water holes, water table falling holes, explosion holes, to strengthen bulkheads and pit edges, dumps and heaps, to install piles in civil engineering works, to reinforce building foundations, to lay service lines, etc.), for drilling and strengthening upper floors, represented by loose and weathered rocks, and also for strengthening areas of tectonic disturbances. etc.

BACKGROUND OF THE INVENTION

It is known in the method of electrothermomechanical drilling and device for its implementation (see Inventor's Certificate No. 1,555,460 Int. Cl. E 21 7(15,1988), which consists in loosening the rock by the passage of current and then in drilling this loosened rock by a mechanical rock-breaking foot and excavating the drill sludge from the hole with an air mixture. This sludge is then divided on fraction, then the coarse fraction is separated, concentrated and broken down thermodynamically outside of the drill pipes.

The device that realizes this method includes a drill bit, a bit chamber, a current collector, an insulating adaptor and a multi-screw spiral, put on an external surface of the cylindrical bit chamber.

However, this method and device are only capable of loosening the rock with the further evacuation of the breakdown products. This method does not strengthen the hole shaft with a solid layer of compressed and thermally transformed rocks.

See also the known device for electrothermal hole drilling (see IC 1,608,340 Int. Cl. E 215 37(18,1988), which we took as a prototype. It includes a rotator, a jib holder, drill jib with waveguide, a compressor, a magnetron, a sludge pipe and a high-temperature penetrator.

This device does not provide sufficiently high drilling speed in loose rocks because the highest temperature is generated directly on the extended circular or conical end of the penetrator and is fed by contact through the melt layer to the rock. Besides, outside the liquid phase of the melt layer in loose rock there is inevitably formed an area of compressed and thermally transformed rock at the expense of its sintering and baking. The high density and strength of the crystalline phase formed in front of the stope, block the mechanical moving of the penetrator and considerably reduce the drilling speed.

SUMMARY OF THE INVENTION

An object of the present invention is to increase the capacity and reduce the expense of drilling holes of different purposes with the simultaneous and reliable lining of the shaft with a layer of thermally transformed rock and vitrified melt.

According to this method the loosening of rocks is realized by their preliminary drying at a temperature of 400–450 K., dehydration (sublimation of bound water) at t° of 700–750 K., burning out organic impurities and dissociation (decomposition) with gas phase separation (for example, carbonates with $CO_2$ separation) at t° of 750–950 K.. The sintering, baking and vitrification of the compressed rock in the hole walls are realized at a temperature of 1800–2300 K.

The device that realizes this method includes a drilling rig with forced feeding, a drill pipe core with a waveguide to channel UHF-energy, a magnetron and a penetrator, the upper end of which is connected with the jib through an adaptor-crystallizer-former. The lower working end of the penetrator is in the form of a rock-breaking cone with a smooth external surface or in the form of a pick drill thermally insulated from the main part of the penetrator.

BRIEF DESCRIPTION OF THE DRAWINGS

Further features and advantages of the invention will be apparent from the description below.

DESCRIPTION OF PREFERRED EMBODIMENT

Figure 1:
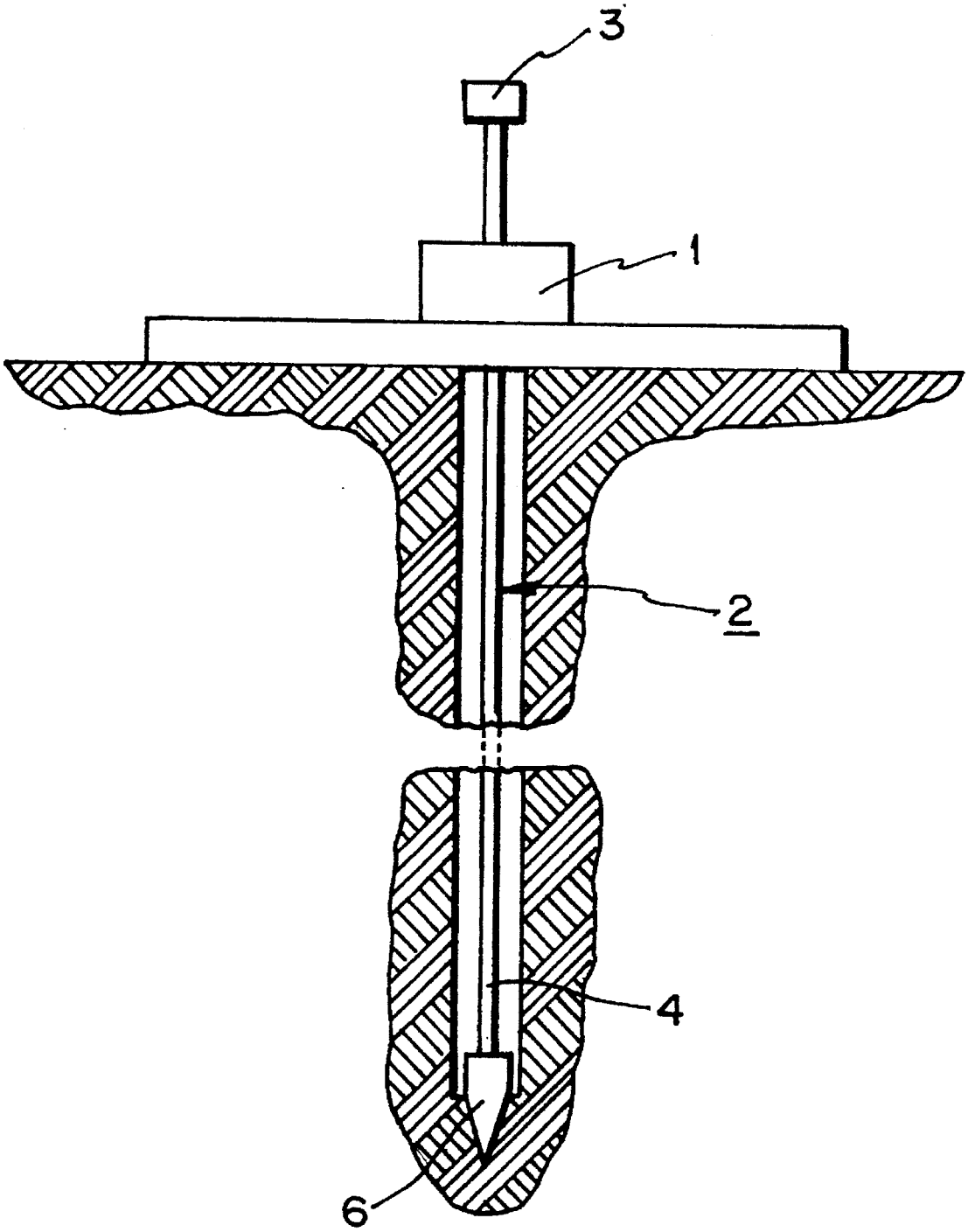
FIG. 1: A general view of the device.

This device for the electrothermomechanical drilling of holes, as shown in FIG. 1, consists of the drilling rig 1 with forced feeding, a drill core 2 and a magnetron 3. The drill core 2 has drill pipes 4 with waveguides 5 to channel the UHF energy, and these are installed in the lower end of the thermomechanical penetrator 6 of the core 2 with its rock-breaking tool tip 7. The drill pipe 4 is represented by two coaxial tubular elements 8 and 9, which form a circular chamber 10 of the waveguide between them. External 8 and internal 9 tubular elements are rigidly connected with centering partitions 11, which are aligned relative to each other in that space, are perpendicular to the pipe's centerline 12 and are displaced in a direction to the centerline 12 at a distance superior or equal to the length of the electromagnetic radiation wave. The relation between the height of the partition displacement 11 and the radiation wavelength is determined by conditions of magnetic flow forming. The drill pipes, with their waveguide 5, form the core 2 by means of threaded connections.

Figure 2:
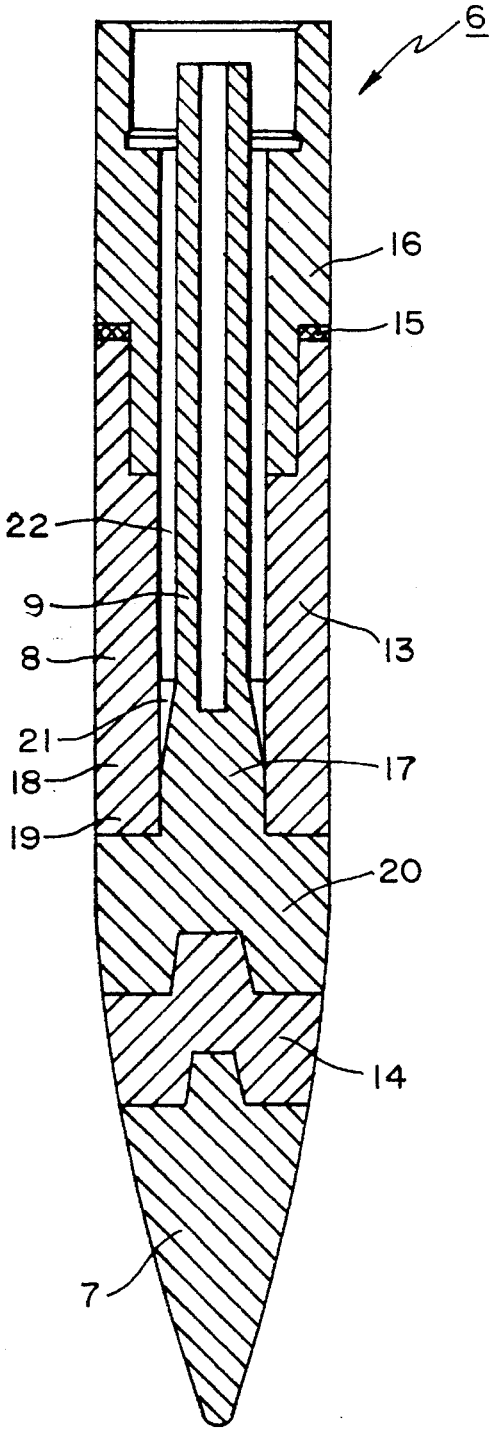
FIG. 2: A thermomechanical penetrator.
Figure 3:
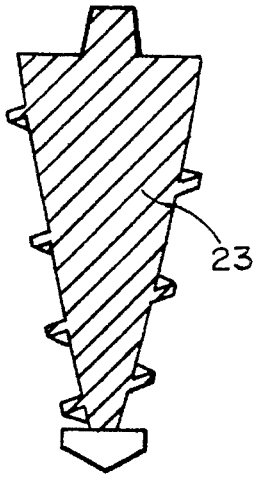
FIG. 3: A rock-breaking foot in the form of a screw.
Figure 4:
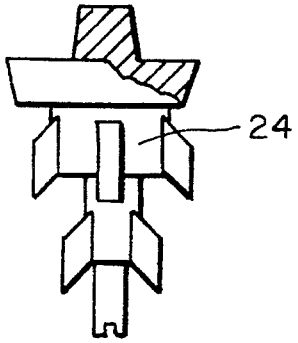
FIG. 4: A rock-breaking foot in the form of a pick drill.
Figure 5A:
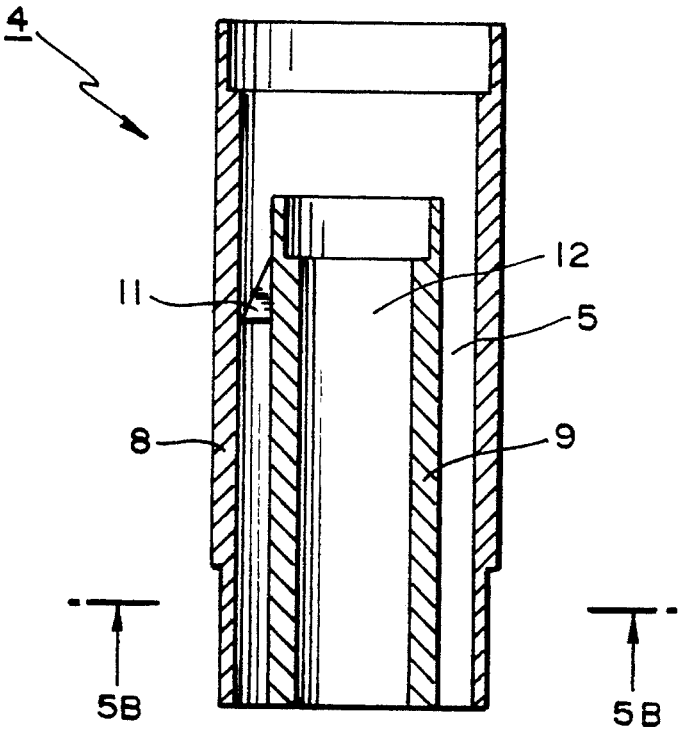
FIG. 5: A drill pipe with waveguide and partitions.
Figure 5B:
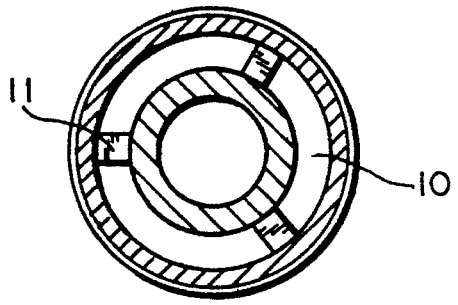

The thermomechanical penetrator 6, as shown in FIG. 2, consists of a heater 13 the lower end of which is rigidly connected with the rock-breaking tool 7 through a heat insulator 14. The rock-breaking tool tip 7 is in the form of a cone with a smooth external surface. The upper end of the heater 13 is rigidly connected with the crystallizer-former 16 through the heat insulator 15. The upper end of the crystallizer-former 16 is connected with the drill cover 2. The materials used for the heater 13, the heat insulators 14 and 15 and the crystallizer-former 16—for example, zirconium oxide, aluminum oxide or siliconize graphite—are remarkable for their nonadhesion to the melt and their high resistance to mechanical attrition. They also provide for a long lifetime in an oxidizing atmosphere (in the rock melt and in the open air) at a high temperature without using inert gas. The heater 13 consists of two tubular elements 8 and 9 the ends of which are closely connected with each other and form a conical chamber 17. The transformation of electric energy into thermal energy takes place due to the shortcircuiting load with the path of transfer of the circular chamber 18 of the waveguide tract into the circular conical chamber 17.

To drill porous rocks, in case of drill core rotation, the penetrator includes a rock-breaking tool in the form of a conical drill screw 23 or pick-drill 24, and which for such purposes the rock-breaking tool is firmly connected with the head insulator 14.

The device is operated after assembly, and installation in the hole when the magnetron 3 is started. Electromagnetic radiation of magnetron 3 at a frequency for example equal to 2–6 $GH_2$, is fed through the waveguide 5 into the heater 13, with its circular conical chamber 17, forming the smooth transformation from coaxial line to shortcircuiting end, with the heater receiving most of the UHF-energy. The losses of electromagnetic radiation passing through the heater 13 transforms the electromagnetic energy into heat energy. In addition, the circular section of the heater's conical chamber 17 is reduced, the electric intensity and, consequently, losses are increased, and as a result, we have the highest heat emission inside the heater 13 of the penetrator 6.

The heat flow is propagated at a working temperature of 1800–2300 K. from the heater 13 through the heat insulator 14 along the rock-breaking tool body, creating a variable temperature of its surface in a range from 750–950 K. at the upper end in contact with the heat insulator 14 to 400–450 K. at its extended end.

The rock-breaking tool cone 7 with its smooth external surface has its lower end heated up to a temperature of 400 K. and the upper end heated up to 950 K. This tool is pressed by the heater into loose rock under the influence of the drilling rig, without any rotation of the drill pipe core. In case of rotation, the rock-breaking tool is used in the form of a conical drill screw or pick (space) drill, reinforced by a hard alloy. In addition to the contact of rock with the rock-breaking tool, we have the drying, dehydration and burning out of organic impurities with the gas phase emission. As a result the loosening of rock layers is reduced and the sintering, baking and vitrification of compressed rock within the hole take place at a temperature of 1800–2300 K. The crystallizer-former 16 assists in forming and strengthening the hole shaft or drill wall with a melt layer.

This method and device provide for a high speed of hole-drilling in loose rocks because the temperature at the working end of the rock-breaking tool is rather low; that is, considerably lower than the melting point of the rock and, as a consequence, under the rock-breaking tool there is no formation of a crystalline rock interlayer which would set up obstacles to the further movement of the mechanical penetrator.

We claim:

1. A method of high speed drilling a hole in a rocky surface/layer with an electrothermomechanical device employing a drill core having a pair of coaxial drill pipes with a waveguide therebetween, and a magnetron with a simultaneous strengthening of the walls of the hole by means of a thermomechanical penetrator comprising:

the steps of loosening and softening the rocky layer by drying same at a temperature from about 400 K. to 450 K. after insertion of said drill core into the rocky layer, followed by dehydration of any water in the hole at temperatures of from about 700 K. to about 750 K., and melting and/or burning out of organic matter and/impurities and disassociation with a separation into a gaseous phase at a temperature from about 750 K. to about 950 K., with final baking and sintering of weakened walls of the hole at a temperature of from about 1800 K. to about 2300 K.; whereby the weakened walls of the hole are strengthened by thermal transformation of the layer with the magnetron's UHF energy channelled thereto by the waveguide formed by said plurality of drill pipes of said drill core, and wherein crystalline rock interlayers are precluded from forming an obstacle to the further movement and penetration of the drill's penetrator into the rocky surface/layer due to the working temperatures of said penetrator being low as compared to that of the rock melting temperatures.

2. A device for use with the method of claim 1, comprising:

a drilling rig, a plurality of hollow drill pipes with a waveguide therebetween for channelling UHF energy, a magnetron, and a heater connected to a crystallizer-former connected at its upper end to the drill core; a penetrator for engaging with a rocky surface/layer, and heat insulators separating said penetrator and said crystallizer-former from said heater; whereby working temperatures of said penetrator are low as compared to rock melting temperatures, and wherein crystalline rock interlayers are thus precluded from forming under said penetrator and forming an obstacle to the further movement and penetration of said device into said rocky surface/layer.

3. The device of claim 2, wherein said penetrator is in the form of a conical screw drill.

4. The device of claim 2, wherein said penetrator is in the form of a pick or spade drill.

* * * * *